US006507150B1

(12) United States Patent
Lin et al.

(10) Patent No.: US 6,507,150 B1
(45) Date of Patent: Jan. 14, 2003

(54) PLASMA DISPLAY PANEL

(75) Inventors: Yih-Jer Lin, Taiwan; Yao-Ching Su, Tainan Hsien, both of (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/465,120

(22) Filed: Dec. 16, 1999

(30) Foreign Application Priority Data

Dec. 18, 1998 (TW) ..... 87121229 A

(51) Int. Cl.[7] ..... H01J 17/49
(52) U.S. Cl. ..... 313/586; 313/582; 313/587
(58) Field of Search ..... 313/582, 583, 313/584, 585, 586, 587, 495, 496, 497; 445/23, 24, 25; 345/41, 42

(56) References Cited

U.S. PATENT DOCUMENTS 5,493,175 A * 2/1996 Kami ..... 313/582 X
6,084,620 A * 7/2000 Ueoka et al. ..... 313/587
6,184,620 B1 * 2/2001 Mori et al. ..... 313/585
6,255,779 B1 * 7/2001 Ha et al. ..... 313/582

* cited by examiner

*Primary Examiner*—Vip Patel
*Assistant Examiner*—Mack Haynes
(74) *Attorney, Agent, or Firm*—Ladas & Parry

(57) ABSTRACT

A front plate of a plasma display panel includes a substrate, a transparent electrode formed on the substrate, and an auxiliary electrode having a first part formed on the transparent electrode and a second part directly formed on the substrate, a dielectric layer formed on the transparent electrode and the first part of the auxiliary electrode, and an isolating layer formed between the substrate and the auxiliary electrode, at a position where the boundary of the dielectric layer intersects the upper surface of the auxiliary electrode. The isolating layer can prevent the auxiliary electrode from being peeled from the substrate.

4 Claims, 5 Drawing Sheets

PLASMA DISPLAY PANEL

BACKGROUND OF THE INVENTION

1. Field of the Invention

This invention relates to a plasma display panel, and more particularly to a front plate of a plasma display panel.

2. Description of Prior Art

Normally, the front plate of a plasma display panel (hereinafter referred to as a PDP) is fabricated by known semiconductor process. These plasma display panels are classified as either transparent type or reflective type in terms of its luminance mechanism. The characteristic of the so-called transparent type PDP is that the fluorescence material is formed on the front plate. On the other hand, in a reflective type PDP the fluorescence material is formed on the rear plate. The reflective type PDP is the topic of the recently researches.

Usually, a plasma display panel includes a front plate and a second plate. A front plate of a plasma display is constituted by forming a plurality of display electrodes including transparent electrodes and auxiliary electrodes on the first substrate. The transparent electrode is normally made of indium tin oxide (ITO). The auxiliary electrode is opaque and normally has a tri-layer structure such as Cr/Cu/Cr or Cr/Al/Cr. Moreover, a plurality of address electrodes, which are orthogonal to the plurality of display electrodes, are formed on the second substrate. A plurality of ribs, parallel to the plurality of address electrodes, are formed on the second substrate for defining a discharge space therebetween. A plurality of fluorescence layers are alternately formed between the plurality of ribs. A voltage is applied between the address electrodes and the display electrodes, ultraviolet light will be generated by the discharge of gas in the discharge space, and the fluorescence layer will absorb the ultraviolet light and emit visible light.

Referring to FIG. 1*a*, the front plate of a plasma display includes a substrate 10, a plurality of transparent electrodes 12 formed on the substrate 10, a plurality of auxiliary electrodes 14, and a dielectric layer 16. Each of the auxiliary electrodes 14 includes a first portion 141 formed on a corresponding transparent electrode and a second portion 142 directly formed on the substrate. Each second portion 142 of the auxiliary electrode is electrically contacted with a bonding pad (not shown) of plasma display. The dielectric layer 16 covers the transparent electrodes and parts of the auxiliary electrodes. A passivation layer (not showed) then covers the whole surface of the displaying area of the substrate.

Please refer to FIGS. 1*b* and 1*c*, which are cross-sectional diagrams of FIG. 1*a* along line I—I' and line III—III', respectively. The dielectric layer 16 covers the first portion 141 of the auxiliary electrodes and a part 1421 of the second portion 142 of the auxiliary electrodes. The other part 1422 of the second portion 142 of the auxiliary electrode is not covered by the dielectric layer 16.

Usually, the dielectric layer is formed by a screen-printing process and then is cured after a sintering process. The dielectric layer will shrink during the sintering process. The second portion 142 of the auxiliary electrode is formed between the dielectric layer 16 and the substrate 10. Because the stress between the dielectric layer and the auxiliary electrode is different from the stress between the auxiliary electrode and the substrate, the shrunk dielectric layer may cause the second portions 142 of the auxiliary electrodes to be peeled from the substrate 10. The peeled electrodes may be oxidized during the high temperature sintering process, and several unwanted black regions will form on the front plate. Moreover, when a voltage is applied on the front plate, the auxiliary electrodes may be broken because of a high voltage drop between the peeled electrodes and the substrate 10. Further, a yellow substrate will be formed on the substrate 10 where the side wall of the dielectric layer 16 intersected with the second portion 142 of the auxiliary electrode. Because of the high voltage between the auxiliary electrode 14 and the substrate 10, the yellow substrate may be formed by a reaction between the auxiliary electrodes and the glass substrate 10. It is so-called "yellow coloring phenomenon", and leads to a color distortion at the edge of the display panel while displaying images. In addition, the manufacturing yield becomes lower since the electrode is easily broken because of the high voltage drop between the auxiliary electrode 14 and the substrate 10.

FIG. 2 is a photograph of the front plate of a conventional PDP. In the picture, the auxiliary electrode is peeled from the substrate at the interface near the boundary of the dielectric layer which is indicated by arrow A. The dielectric layer is shrunk. Because the stress between the glass substrate and the dielectric layer is different from the stress between the auxiliary electrode and the dielectric layer, a stress is occurred between the auxiliary electrode and the glass substrate. The auxiliary electrode will be peeled off and a yellow substrate will also be formed. As long as the auxiliary electrode and the substrate are made of a sodium glass, the yellow coloring phenomenon is unavoidable. According to the understanding of the inventor, all kinds of material for forming the dielectric layer will cause the yellow coloring phenomenon.

SUMMARY OF INVENTION

Accordingly, to overcome the drawbacks of the prior arts, an object of this invention is to provide a front plate of a plasma display panel that can prevent the auxiliary electrode from being peeled from the substrate at the boundary of the dielectric layer.

Another object of this invention is to provide a front plate of a PDP that can increase the manufacturing yield of the PDP by avoiding the occurrence of yellow coloring phenomenon at the boundary of the dielectric layer.

To achieve the above objects, the layout of the front plate is amended. In the present invention, the front plate of a plasma display panel includes a substrate, a transparent electrode formed on the substrate, and an auxiliary electrode having a first portion formed on the transparent electrode and a second portion directly formed on the substrate. The front plate further includes a dielectric layer covered the transparent electrode, the first portion of the auxiliary electrode, and a part of the second portion of the auxiliary electrode, and an isolating layer formed between the substrate and the second portion of the auxiliary electrode, and under a position where the sidewall or boundary of the dielectric layer contacts the upper surface of the second portion of the auxiliary electrode. The isolating layer is formed to reduce the stress between the auxiliary electrode and the substrate, and therefore, the auxiliary electrode will not be peeled from the substrate. The isolating layer also eliminates the occurrence of the yellow substrate on the substrate where the auxiliary electrode contacts with the boundary of the dielectric layer. The yellow coloring phenomenon can be avoided.

BRIEF DESCRIPTION OF THE DRAWINGS

The following detailed description, given by way of example and not intended to limit the invention solely to the embodiments described herein, will best be understood in conjunction with the accompanying drawings in which.

DETAILED DESCRIPTION OF THE PREFERRED EMBODIMENTS

Figure 3A:
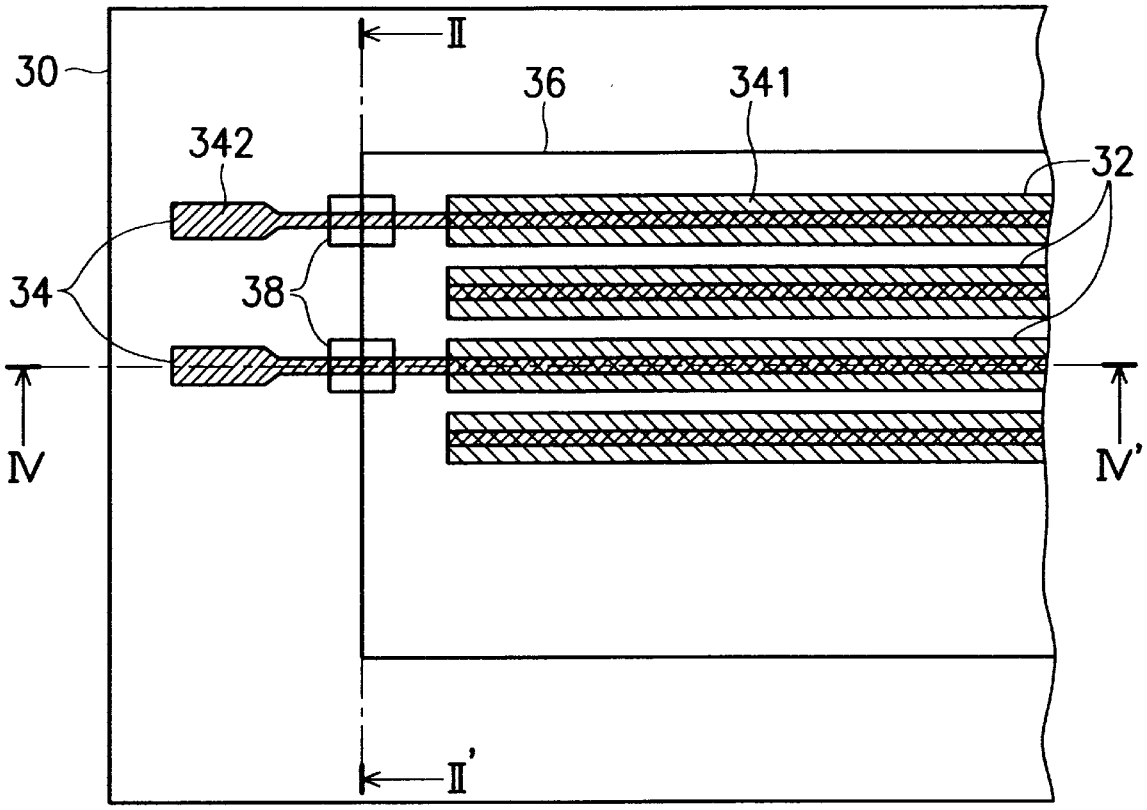
FIG. 3*a* is a diagram showing the layout of the front plate of a PDP according to the present invention.

Referring to FIG. 3*a*, according to the preferred embodiment of this invention, the front plate of a plasma display panel includes a glass substrate 30.

A plurality of transparent electrodes 32 are formed on the glass substrate 30, in which the transparent electrodes are parallel to each other. A plurality of auxiliary electrodes 34 are then formed. Each auxiliary electrode includes a first portion 341 formed on a corresponding transparent electrode and a second portion 342 directly formed on the substrate 30 Further, a dielectric layer 36 is formed to cover the transparent electrodes 32, the first portions 341 of the auxiliary electrodes 34, and parts of the second portions 342 of the auxiliary electrodes 34. Before the dielectric layer 36 and the plurality of auxiliary electrodes 34 are formed, a plurality of isolating layers 38 are formed on the substrate 30 where the sidewall or boundary of the dielectric layer contacts the upper surface of the second portion 342 of the auxiliary electrodes 34.

Figure 3B:
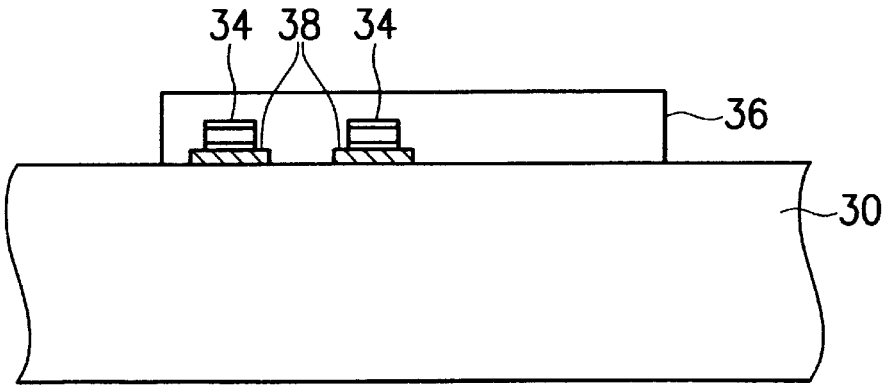
FIG. 3*b* is a sectional diagram of FIG. 3*a* along II—II' line according to the present invention.
Figure 3C:
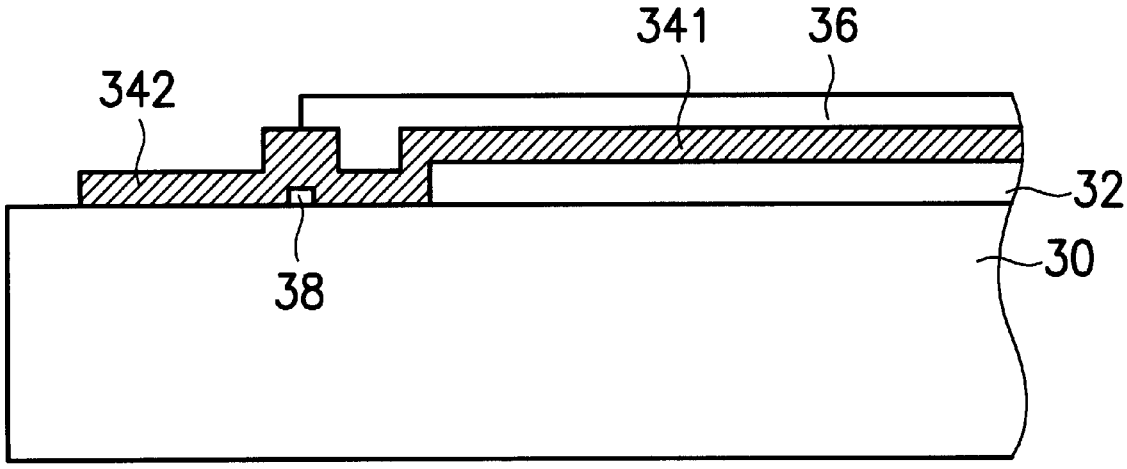
FIG. 3*c* is a sectional diagram of FIG. 3*a* along IV—IV' line according to the present invention.

Please refer to FIGS. 3*b* and 3*c* which are sectional diagrams of FIG. 3*a* along II—II' line and IV—IV' line. As shown in FIGS. 3*b* and 3*c*, each isolating layer 38 is formed between the substrate 30 and the second portion 342 of the auxiliary electrode The auxiliary electrode 34 will not directly contact with the substrate 30 under a position where the sidewall or boundary of the dielectric layer locates on the upper surface of the second portion 342 of the auxiliary electrodes 34 The stress between the auxiliary electrode 34 and the substrate 30 will be eliminated, and the auxiliary electrode 34 will not be peeled from the substrate 30 even if the dielectric layer 36 is shrunk during the sintering process. The auxiliary electrode 34 will not be broken easily when a voltage is applied on the front plate of the PDP. Further, the yellow substrate caused by the reaction between the auxiliary electrode 34 and the substrate 30 will not form on the substrate. The so-called "yellow coloring phenomenon" will not occur.

The material of the isolating layer can be either insulating or non-insulating. For example, the material of the isolating layer can be the same as that of the transparent electrode. In that case, in order to form the isolating layer, the photomask for forming the transparent electrode needs to be amended. It is not necessary to change the manufacturing process or to adjust the parameters. Further, the manufacturing yield of the front plate can be easily improved.

However, it is noted that the area of each isolating layer should be small since the adherence of the auxiliary electrode and the material used to form the transparent electrode is poor. Furthermore, the neighboring two isolating layers can not be so close to avoid causing short circuit.

Figure 1A:
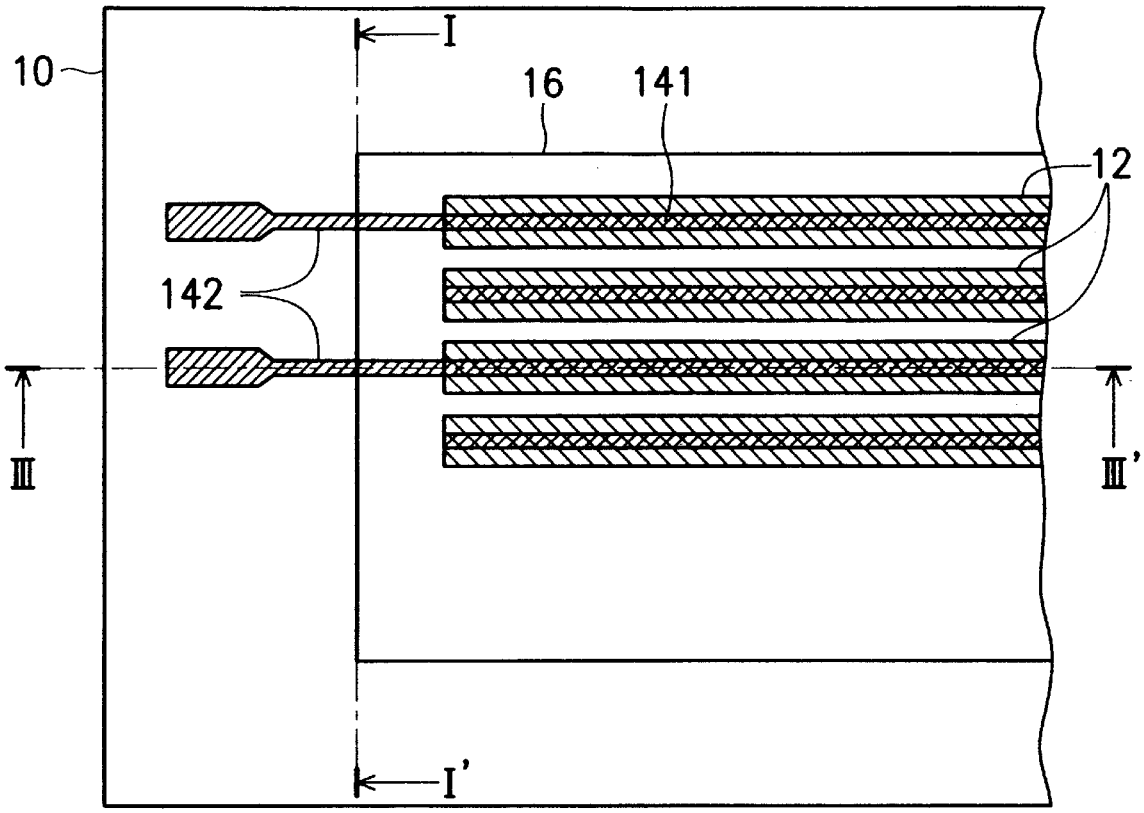
Fig. 1a (Prior Art)
FIG. 1*a* is a partial view illustrating the layout of a front plate of a conventional PDP.
Figure 1B:
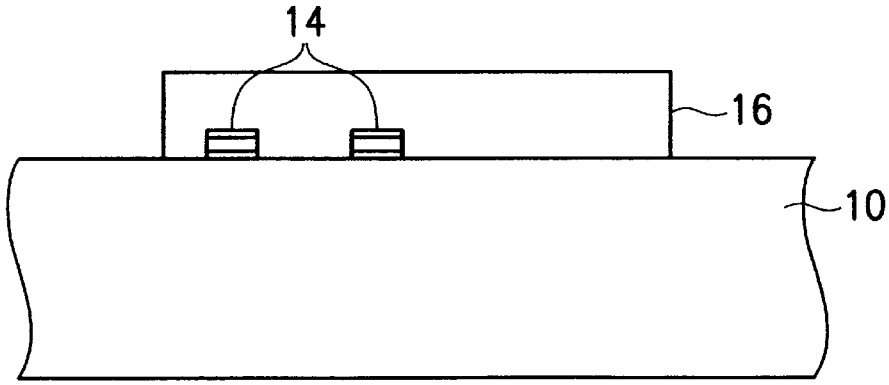
Fig. 1b (Prior Art)
FIG. 1*b* is a sectional diagram of FIG. 1*a* along I—I' line.
Figure 1C:
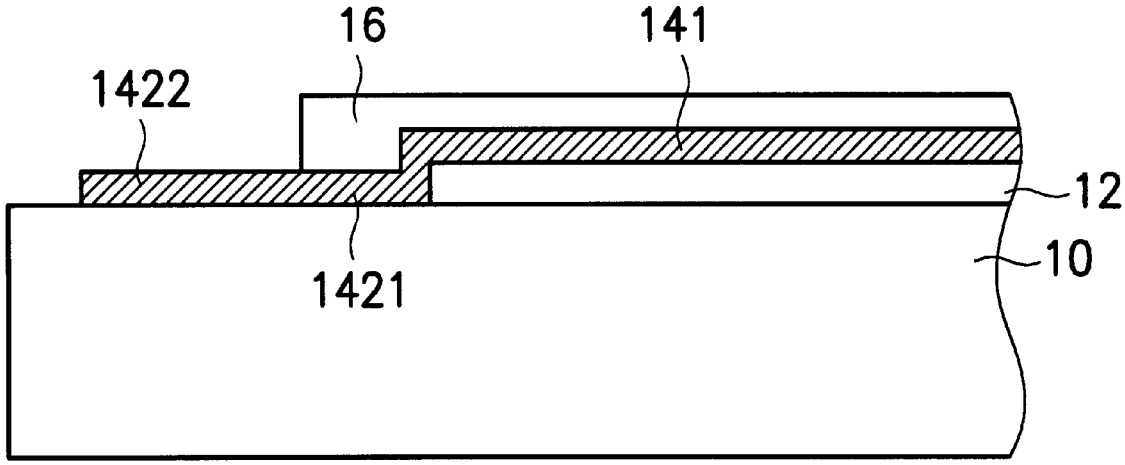
Fig. 1c (Prior Art)
FIG. 1*c* is a sectional diagram of FIG. 1*a* along III—III' line.
Figure 2:
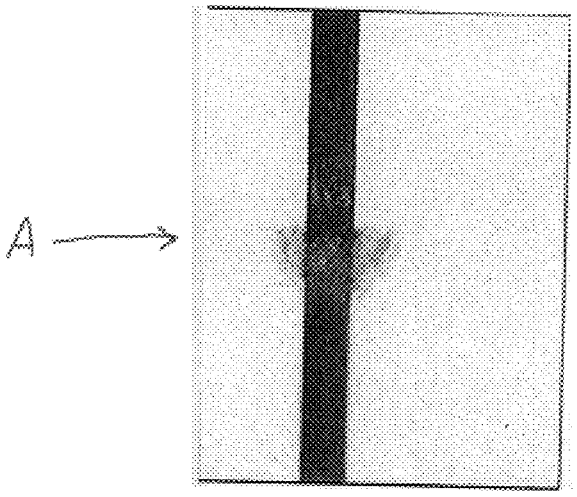
Fig. 2 (Prior Art)
FIG. 2 is a photograph illustrating the top views of the front plate of the conventional PDP.
Figure 4:
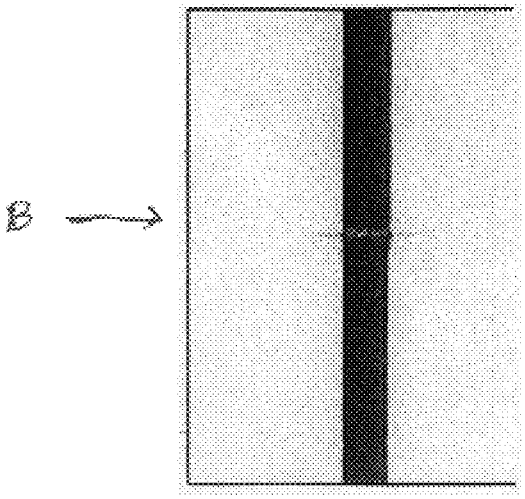
FIG. 4 is a photograph illustrating the top views of the front plate according to the present invention.

Please refer to FIG. 4 which is a photograph showing the top view of the front plate according to the present invention. As indicated by arrow B, the boundary of the transparent dielectric layer is not notably shrunk at the positions where the dielectric layer covers the auxiliary electrodes. The auxiliary electrode is not peeled from the substrate easily. The so-called "yellow coloring phenomenon" is not occurred in this picture.

In conclusion, an isolating layer is added between the substrate and the auxiliary electrode, which is under a position where the sidewall or boundary of the dielectric layer contacts the upper surface of the auxiliary electrode. Using the structure of the front plate disclosed in this invention will not increase the manufacturing cost By making only a small amendment of the photomask for forming the transparent electrode, the problem of broken auxiliary electrode is solved Furthermore, the occurrence of yellow coloring phenomenon can be avoided and the yield is also increased.

While the present invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A front plate of a plasma display panel comprising:

substrate;

a transparent electrode formed on the substrate;

an auxiliary electrode having a first portion formed on the transparent electrode and a second portion directly formed on the substrate;

a dielectric layer formed on the transparent electrode, the first portion of the auxiliary electrode, and a part of the second portion of the auxiliary electrode; and an isolating layer formed between the substrate and the second portion of the auxiliary electrode, and at a position where a boundary of the dielectric layer intersects an upper surface of the second portion of the auxiliary electrode.

2. A front plate of plasma display panel as claimed in claim 1 wherein the isolating layer is made of a material used to form the transparent electrode.

3. A front plate of plasma display panel as claimed in claim 1 wherein the isolating layer is made of indium tin oxide.

4. A front plate of plasma display panel as claimed in claim 1 wherein the isolating layer is located beneath a boundary of the dielectric layer contacting the second portion of the auxiliary electrode.

* * * * *